US006066923A

United States Patent [19]

Noborio et al.

[11] Patent Number: 6,066,923

[45] Date of Patent: May 23, 2000

[54] PLASMA DISPLAY PANEL AND METHOD OF DRIVING PLASMA DISPLAY PANEL

[75] Inventors: Masayuki Noborio; Yoshio Sano, both of Tokyo, Japan

[73] Assignee: NEC Corporation, Tokyo, Japan

[21] Appl. No.: 09/158,003

[22] Filed: Sep. 22, 1998

[30] Foreign Application Priority Data

Sep. 22, 1997 [JP] Japan ..... 9-256624

[51] Int. Cl.[7] ..... G09G 3/10

[52] U.S. Cl. ..... 315/169.4; 345/78; 313/582

[58] Field of Search ..... 315/169.4, 169.3, 315/169.1; 345/60, 37, 66, 67, 78, 68; 313/582, 583, 584, 585, 586, 587

[56] References Cited

U.S. PATENT DOCUMENTS 5,656,893 8/1997 Shino et al. ..... 315/169.4
5,684,499 11/1997 Shimizu et al. ..... 345/169.4
5,844,371 12/1998 Shino et al. ..... 315/169.4
5,903,245 5/1999 Shimizu et al. ..... 345/60
5,969,478 10/1999 Shino et al. ..... 315/169.4

*Primary Examiner*—Haissa Philogene
*Assistant Examiner*—Ephrem Alemu
*Attorney, Agent, or Firm*—McGinn & Gibb, P.C.

[57] ABSTRACT

The scan electrodes are divided into a plurality of groups. These scan electrode groups are divided into those of a scan period and those of a non-scan period in a writing discharge period. A compensation pulse is applied, without application of a scan base pulse, to the electrodes in the non-scan period. Thus it makes possible to suppress electromigration between scan and sustaining electrodes while securing light intensity of emission as in the prior art by using the same techniques as therein.

6 Claims, 10 Drawing Sheets

PLASMA DISPLAY PANEL AND METHOD OF DRIVING PLASMA DISPLAY PANEL

BACKGROUND OF THE INVENTION

The present invention relates to methods of driving plasma display panels and, more particularly, to methods of driving AC discharge plasma display panels having electrodes covered by a dielectric and operable in indirect AC discharge state.

The plasma display panel (hereinafter referred to as PDP) usually has many advantages, such as having a thin structure, being free from flicker, having a large contrast ratio, being capable of relatively readily providing a large display area, being able to provide fast response, and being of self light emission type to permit multiple color light emission by utilizing phosphors. Owing to these advantages, the PDP is recently finding wide-spread applications to the fields of displays concerning computers and color image displays.

PDPs are classified depending on their operating system into an AC discharge type having electrodes covered by a dielectric and operable in an indirect AC discharge state, and a DC discharge type having electrodes exposed to a discharge space and operable in a DC discharge state. The AC discharge PDPs have advantages in eliminating spattering of electrodes due to discharge and long life. The AC PDPs are further classified depending on the drive system into a memory type which utilizes a discharge cell memory, and a refresh type which does not utilize any such memory.

The PDP light intensity is proportional to the number of discharge times, i.e., the number of repeated pulse voltage applications. In the refresh type PDP, the light intensity is reduced with increasing display capacity. Therefore, this type is adopted for only small discharge capacity PDPs.

FIG. 7 is a sectional view showing an example of the AC discharge memory type PDP.

As shown in the FIG. 7, this PDP comprises a rear and a front insulating substrate 1 and 2 of glass, a scan and a sustaining electrode 3 and 4, which are transparent and formed at a predetermined spacing therebetween on the substrate 2 and constitute each of a plurality of parallel electrode sets, tracing electrodes 5 and 6 formed on the scan and sustaining electrodes 3 and 4 for reducing the electrode resistance thereof, a dielectric layer 12 covering the scan, sustaining and tracing electrodes 3 to 6, a protective layer 13 of magnesium oxide or like material laminated on the dielectric layer 12 for protecting the same layer 12 from discharge, a plurality of parallel data electrodes 7 (only one thereof being shown) formed on the substrate 1 such as to cross the scan and sustaining electrodes 3 and 4, a dielectric layer 14 covering the data electrodes 7, a plurality of discharge gas spaces 8 (only one thereof being shown) formed between the substrates 1 and 2 and filled with discharge gas, e.g., of helium, neon, xenon, etc. or a mixture of these gases, a partitioning wall member 9 provided on the dielectric layer 14 to form the discharge gas spaces 8 and define display cells, and phosphor 11 coated on the dielectric layer 14 and also on the side wall surfaces of the partitioning wall member 9 for converting ultraviolet rays generated with discharge of the discharge gas filled in the discharge gas spaces 8 to visible light 11.

The actual PDP, for instance a VGA panel, has a cell pixel matrix on the display area, having 480 rows or lines and 1,920 columns of display cells or pixels like those noted above, 480 scan electrodes 3 and the same number of sustaining electrodes 4, and 1,920 data electrodes 7. As the pitch of pixels, the data electrode pitch is 0.35 mm, and the scan electrode pitch is 1.05 mm. The scan electrodes are at a distance of 0.2 mm from the data electrodes, and the scan and sustaining electrodes 3 and 4 in each electrode set are spaced apart by 0.1 mm.

The discharge operation of the PDP having the above construction will now be described.

By applying a pulse voltage in excess of a discharge threshold level is applied between the scan and data electrodes 3 and 7, discharge is initiated. As a result, positive and negative charges are attracted to and deposited on either ones of the surfaces of the opposite side dielectrics 12 and 14 in dependence on the polarity of the pulse voltage. The equivalent internal voltage that arises from the charge deposition, i.e., wall voltage, has the opposite polarity to the applied pulse voltage. For this reason, with the progress of discharge, the effective voltage across the cell is reduced. Therefore, in spite of the constant pulse voltage level, it eventually becomes unable to sustain discharge, resulting in de-sustaining thereof.

By subsequently applying a sustaining pulse, which is a pulse voltage of the same polarity as the wall voltage, between the scan and sustaining electrodes 3 and 4, the wall voltage is superimposed as effective voltage on the sustaining pulse. Thus even if the voltage amplitude of the externally applied sustaining pulse is low, the voltage across the cell is held above the discharge threshold level, and the discharge can be sustained.

The discharge thus can be sustained by continuously applying the sustaining pulse between the scan and sustaining electrodes 3 and 4.

The sustained discharge can be de-sustained by applying, to the scan or sustaining electrode 3 or 4, an erasing pulse, which is a wide low voltage pulse or a narrow pulse with a level of the order of the sustaining pulse voltage such as to neutralize or cancel the wall voltage.

FIG. 8 is a schematic plan view showing the PDP having the display cell matrix array as shown in FIG. 7.

As shown in FIG. 8, the PDP 15 is a dot matrix display panel having display cells 16 in a dot matrix array of j rows and k columns. As row electrodes, the PDP has parallel scan electrodes $S_{c1}, S_{c2}, \ldots, S_{cj}$ and sustaining electrodes $S_{u1}, S_{u2}, \ldots, S_{uj}$ and as column electrodes it has data electrodes $D_1, D_2, \ldots, D_k$ crossing the scan and sustaining electrodes.

FIG. 9 is a waveform chart showing a prior art example of drive pulses for driving the PDP shown in FIG. 8. This example is proposed in Society for Information Display International Symposium Digest of Technical Papers, Vol. XXVI, 1995, pp. 807–810.

In the FIG. 9, labeled $W_u$ is a sustaining electrode drive voltage waveform applied commonly to the sustaining electrodes $S_{u1}, S_{u2}, \ldots S_{uj}$. Labeled $W_{s1}, W_{s2}, \ldots W_{sj}$ are scan electrode drive voltage waveforms applied to the scan electrodes $S_{c1}, S_{c2}, \ldots, S_{cj}$, respectively. Labeled $W_d$ is a data electrode drive voltage waveform applied to the data electrode $D_i$ (123 $i \leqq k$).

As shown in FIG. 9, the PDP drive cycle consists of a priming discharge period A, a writing discharge period B and a sustaining period C. Desired image display can be obtained with repeated discharge in these periods.

In the priming discharge period A, active particles and wall charge are generated in each discharge gas space 8 (see FIG. 7) in order to obtain stable writing discharge characteristics in the writing discharge period B. In this period, a priming discharge pulse $P_p$ is first applied to the sustaining electrodes to simultaneously cause discharge in all the display cells of the PDP 15. Then, a priming discharge erase pulse $P_{pe}$ is simultaneously applied to all the scan electrodes to remove or reduce those charge parts of the wall charge generated in this period which impede the writing discharge and the sustained discharge.

Specifically, the priming discharge pulse $P_p$ is first applied to the sustaining electrodes $S_{u1}, S_{u2}, \ldots, S_{uj}$ cause discharge in all the cells, and then the priming discharge erase pulse $P_{pe}$ is applied to the scan electrodes $S_{c1}, S_{c2}, \ldots, S_{cj}$ to bring about erase discharge for erasing the charge parts of the charge deposited by the priming discharge pulse $P_p$ which impede the writing discharge and the sustained discharge.

In the writing discharge period B, a scan base pulse $P_b$ is first applied to all the scan electrodes $S_{c1}, S_{c2}, \ldots, S_{cj}$. Then, successive scan pulses $P_w$ are applied to the scan electrodes $S_{c1}, S_{c2}, \ldots, S_{cj}$, and in synchronism to the scan pulses $P_w$ data pulses Pd are selectively applied to the data electrodes $D_i$ ($1 \leqq i \leqq k$) in the display cells to be driven for display. Thus, writing discharge is caused to generate wall charge in the cells to be driven.

By applying the scan base pulse $P_b$, it is possible to reduce the level of the scan base pulse $P_w$, thus reducing the maximum working voltage level of a high break-down voltage IC which generates the scan pulses $P_w$ and reducing the cost of the drive IC, when the level of the scan pulses $P_w$ is high, the rising of the scan pulse $P_w$ causes undesired discharge tending to de-sustain the writing discharge, which is brought about by the scan and data pulses. By applying the scan base pulse $P_b$, the level of the scan pulse $P_w$ can be reduced to eliminate the undesired discharge.

In the sustaining period C, a sustaining pulse $P_u$ is applied to the sustaining electrodes, while applying a sustaining pulse $P_s$ lagging in phase by 180 degrees behind the sustaining pulse $P_u$ to each scan electrode, thus sustaining discharge necessary to obtain a desired light intensity in the display cells, in which the writing discharge was brought about in the writing discharge period B.

A method of gradation display with the above PDP will now be described.

In the PDP, unlike other devices, it is difficult to obtain high light intensity gradation display by causing applied voltage changes. Generally, therefore, the gradation display is obtained by controlling the number of times by which to cause light emission. Particularly, a sub-field method as will be described in the following is used for high light intensity gradation display.

FIG. 10 is a view for describing the sub-field method. In the Figure, the ordinate is taken for the scan electrode column, and the abscissa is taken for time.

Usually, one frame image is set during one filed as shown in FIG. 10. One field is largely set to be in a range of 1/47 to 1/76 second, although it varies with computers and broadcasting systems.

In the gradation image display using the PDP, as shown in FIG. 10, one field is divided into k sub-fields (i.e., sub-fields SF1 to SF6, k=6 in the case shown in FIG. 10), each sub-field being constituted by one PDP drive cycle as shown in FIG. 9.

The light intensity of emission in each pixel in each sub-field is controlled by weight multiplying the number of times of sustained discharge light emission in the pixel by $2^n$, and is given as:

$$Intensity = \sum_{n=1}^{k} \{L_1 \times 2^{(n-1)} \times a_n\}$$

In formula (1), n is sub-field number, being "1" for the lowest light intensity sub-field and "k" for the highest light intensity sub-field. $L_1$ is the light intensity of the lowest light intensity sub-field. $a_n$ is a variable having value of either "1" or "0" and being "1" when driving pertinent pixels in the n-th sub-field for light emission and "0" otherwise. Since the light intensity of emission varies with the sub-fields, the light intensity can be controlled by selecting "on" and "off" states in each field.

The sub-fields shown in FIG. 10 have different time lengths. This is so because the number of times of the sustained discharge, i.e., the number of applied sustaining pulses $P_u$ and $P_n$, is different with different sub-fields.

In the case shown in FIG. 10, k=6. When this case is applied to color display with a red, a green and a blue color pixel as a set, a gradation display of $2^k=2^6=64$ gradations is obtainable. Also, it is possible to obtain a display in $64^3=262{,}144$ different colors (including black). In case of k=1, one field is constituted by one sub-field, and two gradations (i.e., "on" and "off" gradations) are obtainable in each color. Also, a display in $2^3=8$ different colors (including black) is obtainable.

In the PDP, its electrodes are formed on insulating substrate of glass and covered by glass graze, which is a dielectric constituted by glass paste. For this reason, a phenomenon called electromigration takes place, which is the precipitation of a glass graze component on the electrode surface due to an effective DC bias applied between the scan and sustaining electrodes. By the term "effective DC bias" is meant not a purely DC bias but a voltage deviation in the integration of the voltage applied between the scan and sustaining electrodes over one drive cycle.

FIG. 11 is a view showing an example of voltage waveforms, which brings about the electromigration.

When the voltages of the waveforms as shown in FIG. 11 are applied to the scan and sustaining electrodes, respectively, it reduces to the equivalence, when viewed from the scan or sustaining electrode side, that a negative bias of −50 V is applied for 10 msec. to the scan electrode.

In the meantime, for obtaining a gradation display of 62 gradations, at least 6 drive cycles are necessary in a field as shown in FIG. 10. When the image is to be re-written at 60 Hz, it is equivalent to 6×60 DC bias application periods in one second.

This DC bias brings about electromigration, i.e., migration of ions in the direction of the electric field. As a result, projections like tree branches grow between the scan and sustaining electrodes, and ultimately cause short-circuit thereof with one another.

Even without short-circuit caused between the scan and sustaining electrodes, the projections grown thereon are of a conductive material, and increase the effective electrode area. This means that the effective discharge gap between the scan and sustaining electrodes is reduced.

Such effective discharge gap reduction extremely reduces the initial discharge voltage in a short period of time. That is, even when a voltage which permits normal image display is initially set, erroneous "on" pixels are caused in a short period display operation. This erroneous "on" pixels disable maintaining normal display operation.

A measure for preventing the above phenomenon is described in Japanese Patent Laid-Open Publication No. 8-160909. FIG. 12 is a view showing an example of drive waveforms for preventing the electromigration.

In the Figure, designated at A is a priming discharge period, at B a writing discharge period, at C a sustaining period, at $P_p$ a priming discharge pulse, at $P_b$ a scan base pulse, at $P_w$ scan pulses, at $P_x$ a pulse of voltage of 50 V, at $P_u$ sustaining electrode side sustaining pulses, and $P_s$ scan electrode side sustaining pulses.

In this example, of the scan electrode side sustaining pulses applied in the sustaining period C, the last one is continued into a pause period. This last pulse cancels a DC voltage that is applied between the scan and sustaining electrodes in the writing discharge period B.

In this prior art PDP drive method, in which a sustaining pulse applied in the pause period cancels the DC voltage applied between the scan and sustaining electrodes in the writing discharge period, the pause period should be set to be equal in time length to the writing discharge period. However, the pause period may not always be set to be equal to the writing discharge period In other words, the pause period may be set to be equal to the writing discharge period with a sacrifice in the sustaining period. In such a case, the result may be the failure of obtaining sufficient light intensity.

This prior art method has another problem. The voltage of the last sustaining pulse applied to the scan electrode side, is different from the voltage applied between the scan and sustaining electrodes in the writing discharge period. However, the effect of electromigration varies non-linearly with respect to the last applied sustaining pulse voltage. Therefore, it is difficult to determine the level and pulse length of the compensation pulse voltage, which is applied to the scan electrode side during the pause period in order to perfectly cancel the DC bias voltage in the writing discharge period.

SUMMARY OF THE INVENTION

The present invention was made in view of the above problems inherent in the prior art, and it has an object of providing a method of driving a plasma display panel, which is free from reduction of the light intensity of emission due to sustaining period sacrifice, while suppressing reduction of the initial discharge voltage due to tree-branch-like projections precipitated between the scan and sustaining electrodes as a result of electromigration.

According to an aspect of the present invention, there is provided a method of driving the plasma display panel, in a plasma display comprising a plurality of scan electrodes provided on an insulating substrate, sustaining electrodes provided on the same insulating substrate such as to be paired with the scan electrodes, respectively, and parallel with the same, and a plurality of data electrodes provided on an insulating substrate facing the scan and sustaining electrodes such as to cross the same, data voltage corresponding to display data being supplied to the data electrodes, the method of driving the plasma display panel, in which display data is written in display cells by applying scan pulses to the scan electrodes during a scan period, during which a scan base pulse of a constant voltage is applied to the scan electrodes, comprising the steps of:

dividing the plurality of scan electrodes into a plurality of scan electrode groups having different scan periods; and applying a compensation pulse voltage to the scan electrodes in the scan electrode groups, which are in the non-scan periods during a writing discharge period of writing the display data in the display cells, to make up for a potential deviation generated between the scan and sustaining electrodes during the scan period.

The plurality of scan electrodes are divided into two scan electrode groups at the center of the electrode array in the scan direction thereof. The plurality of scan electrodes are divided into two scan electrode groups each constituted by every other scan electrodes in the scan direction.

According to another aspect of the present invention, there is provided a method of driving the plasma display panel, in a plasma display comprising a plurality of scan electrodes provided on an insulating substrate, sustaining electrodes provided on the same insulating substrate such as to be paired with the scan electrodes, respectively, and parallel with the same, and a plurality of data electrodes provided on an insulating substrate facing the scan and sustaining electrodes such as to cross the same, data voltage corresponding to display data being supplied to the data electrodes, the method of driving the plasma display panel, in which display data is written in display cells by applying scan pulses to the scan electrodes during a scan period, during which a scan base pulse of a constant voltage is applied to the scan electrodes, comprising the steps of:

dividing the pluralities of scan and sustaining electrodes into a plurality of scan and sustaining electrode groups having different scan periods; and applying a compensation pulse voltage to the scan and sustaining electrodes in the scan and sustaining electrode groups, which are in the non-scan periods during a writing discharge period of writing the display data in the display cells, to make up for a potential deviation generated between the scan and sustaining electrodes during the scan period.

According to other aspect of the present invention, there is provided a plasma display comprising a plurality of scan electrodes provided on an insulating substrate, sustaining electrodes provided on the same insulating substrate such as to be paired with the scan electrodes, respectively, and parallel with the same, and a plurality of data electrodes provided on an insulating substrate facing the scan and sustaining electrodes such as to cross the same, data voltage corresponding to display data being supplied to the data electrodes, display data being written in display cells by applying scan pulses to the scan electrodes during a scan period, during which a scan base pulse of a constant voltage is applied to the scan electrodes, wherein the plurality of scan electrodes are divided into a plurality of scan electrode groups having different scan periods; and a compensation pulse voltage is applied to the scan electrodes in the scan electrode groups, which are in the non-scan periods during a writing discharge period of writing the display data in the display cells, to make up for a potential deviation generated between the scan and sustaining electrodes during the scan period.

According to still other aspect of the present invention, there is provided a plasma display comprising a plurality of scan electrodes provided on an insulating substrate, sustaining electrodes provided on the same insulating substrate such as to be paired with the scan electrodes, respectively, and parallel with the same, and a plurality of data electrodes provided on an insulating substrate facing the scan and sustaining electrodes such as to cross the same, data voltage corresponding to display data being supplied to the data electrodes, display data being written in display cells by applying scan pulses to the scan electrodes during a scan period, during which a scan base pulse of a constant voltage is applied to the scan electrodes, wherein the pluralities of scan and sustaining electrodes are divided into a plurality of scan and sustaining electrode groups having different scan periods; and a compensation pulse voltage is applied to the scan and sustaining electrodes in the scan and sustaining electrode groups, which are in the non-scan periods during a writing discharge period of writing the display data in the display cells, to make up for a potential deviation generated between the scan and sustaining electrodes during the scan period.

In the PDP, the tree-branch-like projection generation reaction is usually a reversible reaction. Thus, when a DC bias deviation is generated, the generation of tree-branch-like projections can be prevented by applying an equivalent and opposite polarity DC bias.

According to the present invention providing the above construction, the scan electrodes are divided into a plurality of groups having either a scan or a non-scan period during the writing discharge period, and a compensation pulse is applied, without application of any scan base pulse, to the scan electrodes in the non-scan period. Thus, DC bias that was heretofore generated by the scan base pulse is perfectly eliminated.

Besides, according to the present invention it is possible to reduce the period of application of the scan base pulse which was a cause of the voltage deviation.

Furthermore, without need of providing any pause period for applying a compensation pulse voltage to make up for the tree-branch-like projection generation reaction, the sustaining period is not sacrificed.

It is thus possible to suppress the electromigration between the scan and sustaining electrodes while securing light intensity of emission as in the prior art.

Other objects and features will be clarified from the following description with reference to attached drawings.

PREFERRED EMBODIMENTS OF THE INVENTION

Preferred embodiments of the present invention will now be described with reference to the drawings.

Figure 1:
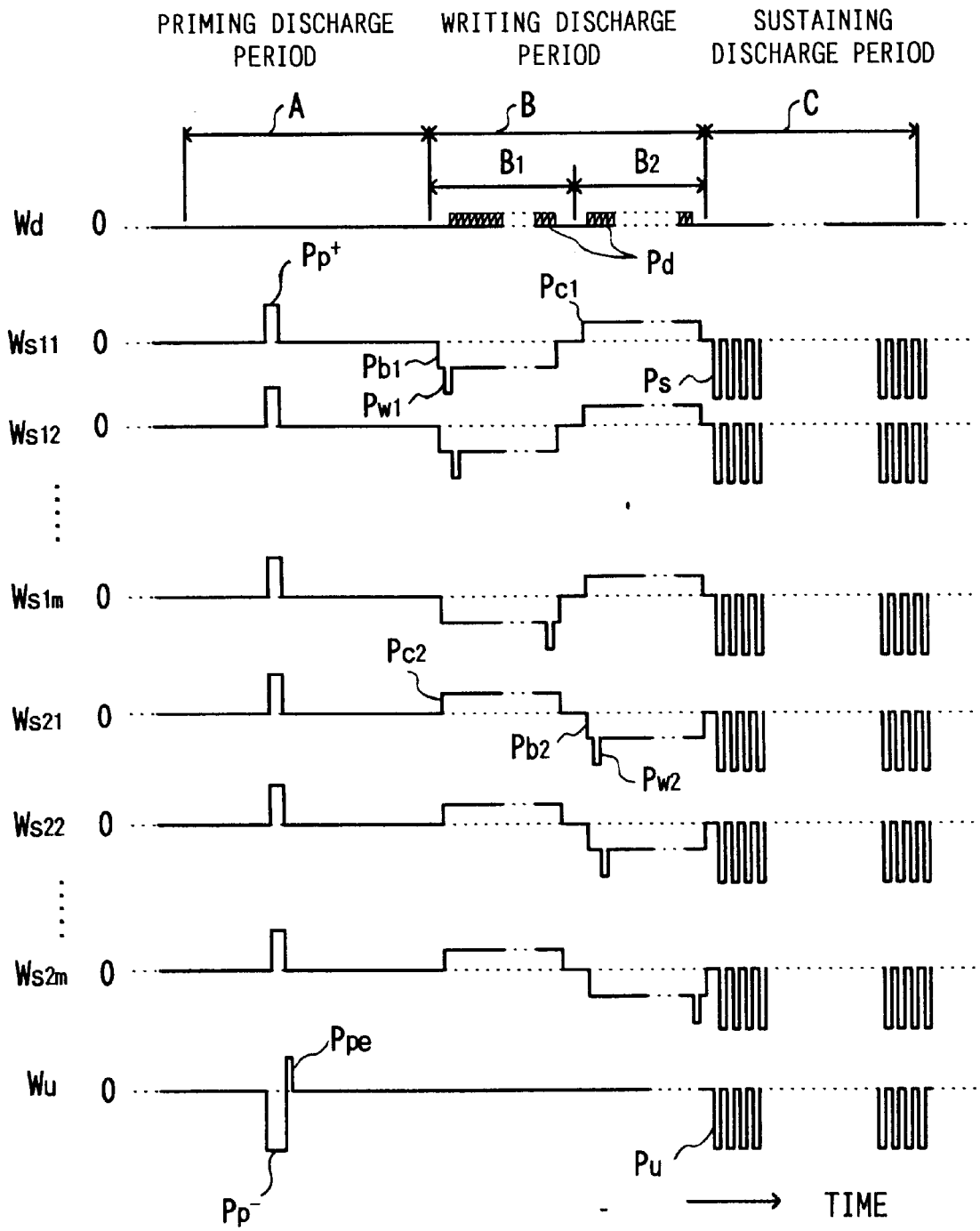
FIG. 1 is a waveform chart showing drive pulses for describing a first embodiment of the PDP driving method according to the present invention.
Figure 2:
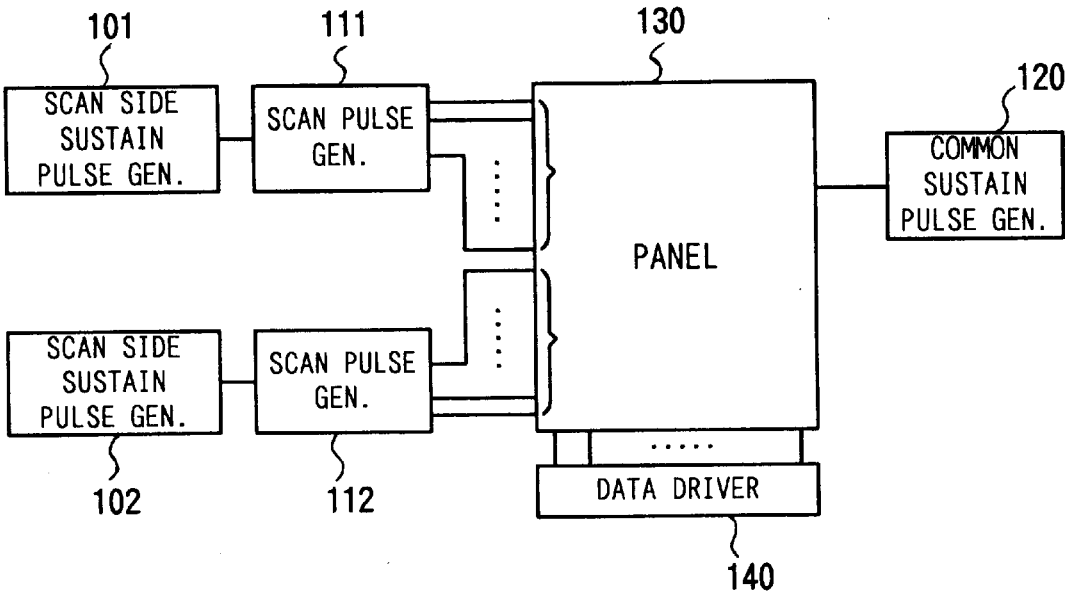
FIG. 2 is a block diagram showing a drive circuit for realizing the PDP driving method shown in FIG. 1.
Figure 7:
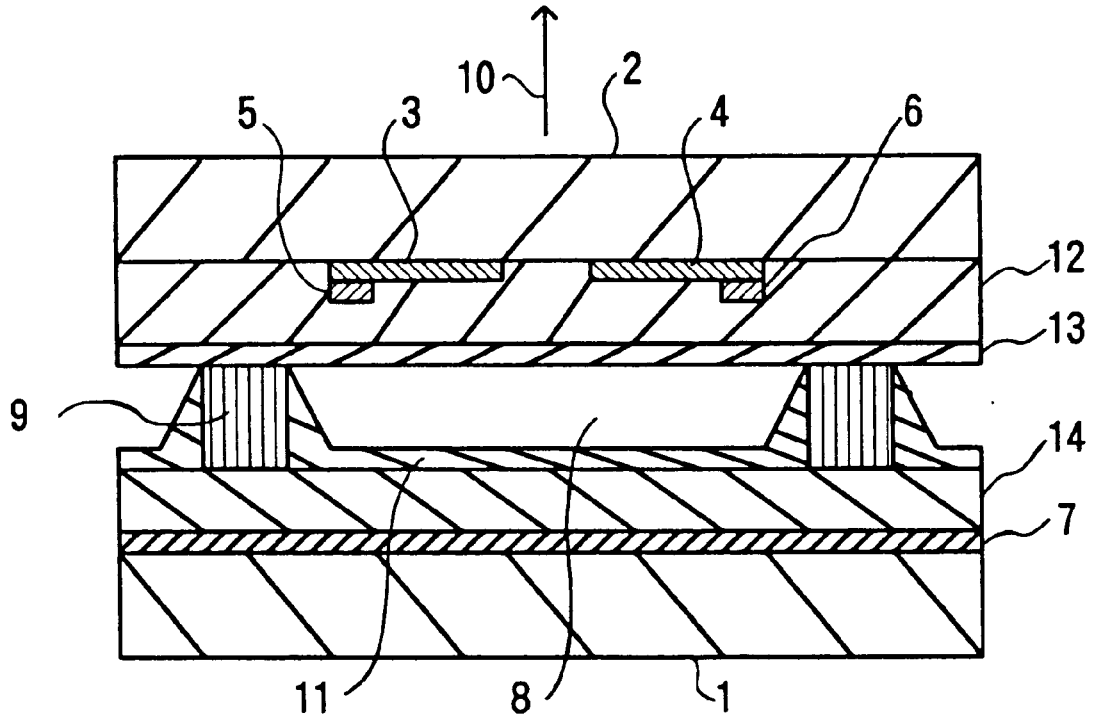
FIG. 7 PRIOR ART
FIG. 7 is a sectional view showing an example of the AC discharge memory type PDP.
Figure 8:
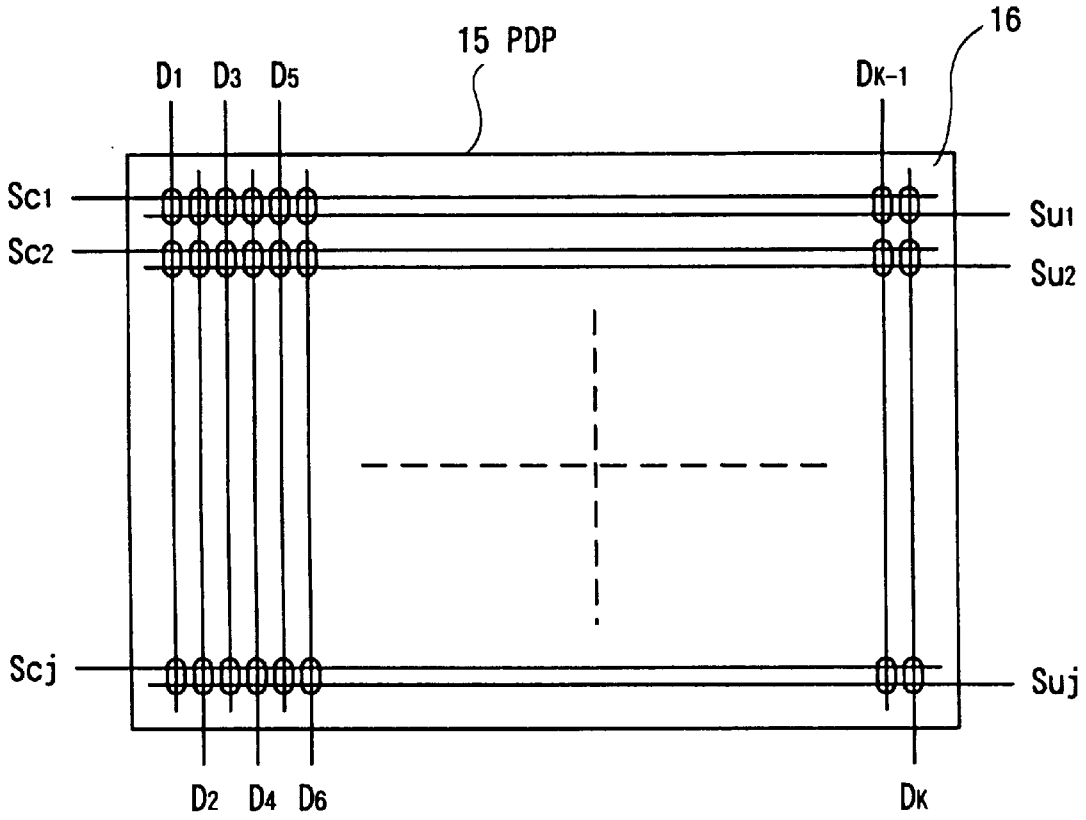
FIG. 8 PRIOR ART
FIG. 8 is a schematic plan view showing the PDP having the display cell matrix array as shown in FIG. 7.

FIG. 1 is a waveform chart showing drive pulses for describing a first embodiment of the PDP driving method according to the present invention. FIG. 2 is a block diagram showing a drive circuit for realizing the PDP driving method shown in FIG. 1. In this embodiment, a PDP having the electrode array as shown in FIGS. 7 and 8 is used again.

In this embodiment, as shown in FIG. 2, the scan electrodes in the PDP 130 are divided into two, i.e., first and second, groups. Scan electrode side sustaining pulse to generators 101 and 102 for generating sustaining pulses to be applied to the scan electrodes and scan pulse generators 111 and 112 for generating scan pulses to be applied to the scan electrodes, are connected to the first and second scan electrode groups, respectively. A data driver 140 and a common sustaining pulse generator 120 for generating sustaining pulses to be applied to the sustaining electrodes, are further connected to the PDP 130.

Of the scan electrodes $S_{c1}$ to $S_{cj}$ (j being an even number), the scan electrodes $S_{c1}$ to $S_{cm}$ (m=j/2) constitute the first scan electrode group, and are designated by $_{Sc11}$, $S_{c12}$, . . . , $S_{c1m}$. Of the scan electrodes $S_{c1}$ to $S_{cj}$, the scan electrodes $S_{c(m+1)}$ to $S_{cj}$ constitute the second scan electrode group, and are designated by $S_{c21}$, $S_{c22}$, . . . , $S_{c2m}$.

Referring to FIG. 1, designated by $W_u$ is a sustaining electrode drive voltage waveform applied commonly to the sustaining electrodes $S_{u1}$, $S_{u2}$, . . . , $S_{uj}$, $W_{s11}$, $W_{s12}$, . . . , $W_{s1m}$ scan electrode drive voltage waveforms applied to the scan electrodes $S_{c11}$, $S_{c12}$, . . . , $W_{c1m}$, respectively, in the first scan electrode group, $W_{s21}$, $W_{s22}$, . . . ,. $W_{s2m}$ scan electrode drive voltage waveforms applied to the scan electrodes $S_{c21}$, $S_{c22}$, . . . , $S_{c2m}$, respectively, in the second scan electrode group, and $W_d$ a data electrode drive voltage waveform applied to the data electrodes $D_1$, $D_2$, . . . , $D_k$.

One PDP drive cycle is constituted by a priming discharge period A, a writing discharge period B and a sustaining discharge period C. Desired image is obtained by repeating this drive cycle.

In the priming discharge period A, priming discharge is brought about by applying a negative priming discharge pulse $P_p^-$ to all the sustaining electrodes and a positive priming discharge pulse $P_p^+$ to all the scan electrodes, and then is once de-sustained by applying a positive priming discharge erase pulse $P_{pe}$ to all the sustaining electrodes.

As an alternative of the way of bringing about the priming discharge, it is possible to apply the priming discharge pulse $P_p^-$ to the sustaining electrodes without applying the priming discharge pulse $P_p^+$ to the scan electrodes, and then apply the priming discharge erase pulse $P_{pe}$ to all the scan electrodes.

In the sustaining period C, as in the prior art, opposite polarity pulses are alternately applied to the scan and sustaining electrodes.

The operation in the writing discharge period B will now be described.

The writing discharge period B is divided into a first and a second writing discharge period $B_1$ and $B_2$ set as scan periods for the first and second scan electrode groups, respectively. In the first writing discharge period $B_1$, a scan base pulse $P_{b1}$ is applied, and in superimposition thereon scan pulses $P_{w1}$ are applied. In this writing discharge period, a compensation pulse $P_{c2}$ is applied to the second group scan electrodes to make up for DC bias generated in the drive sequence. That is, the first writing discharge period $B_1$ is a non-scan period for the second group scan electrodes.

The second writing discharge period $B_2$ which is the scan period for the second group scan electrodes, is provided such that it does not overlap the first writing discharge period $B_1$ as the scan period for the first group scan electrodes. Thus, after completion of the scanning of the first group scan electrodes, a scan base pulse $P_{b2}$ and scan pulses $P_{w2}$ are applied to the second group scan electrodes. In this period $B_2$, a compensation pulse $P_{c1}$ is applied to the first group scan electrodes. The second scan period $B_2$ is thus a non-scan period for the first group scan electrodes.

The compensation pulses $P_{c1}$ and $P_{c2}$ are of the opposite polarity to the scan base pulses $P_{b1}$ and $P_{b2}$, but are the same in the voltage level and time length as the compensation pulses $P_{c1}$ and $P_{c2}$. Thus, they can perfectly cancel the DC bias due to the scan base pulses $P_{b1}$ and $P_{b2}$.

In the prior art, a compensation pulse which is different in the voltage level and time length from the scan base pulse is used to cancel the DC bias. However, since the electromigration effect varies non-linearly with respect to the voltage, it has been difficult to cancel the effect of the DC bias with a different voltage.

According to the present invention, the compensation pulse which is the same in the voltage level and time length as the scan base pulse generating the DC bias, is used, so that it is possible to readily obtain a perfect compensation effect. Besides, no particular pause period is necessary for applying the compensation pulse. That is, the insertion of the compensation pulse does not result in reduction of the sustaining period and reduction of the light intensity of emission.

The method of dividing the scan electrodes into two groups as described above, is by no means limitative.

Figure 3:
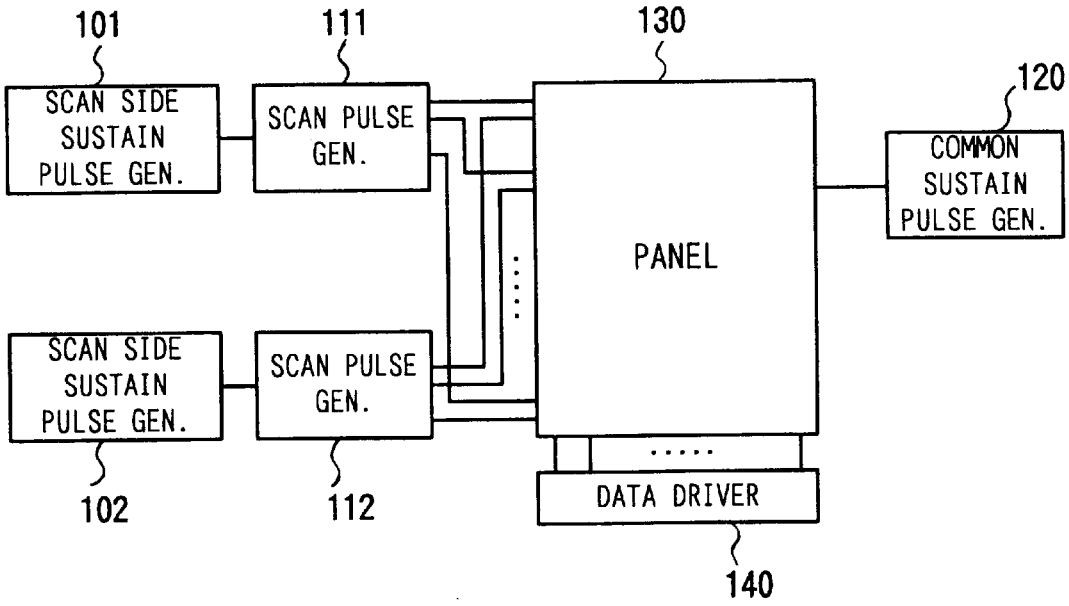
FIG. 3 is a block diagram showing a modification of the method of dividing the scan electrodes into two groups in the drive circuit shown in FIG. 2.

FIG. 3 is a block diagram showing a modification of the method of dividing the scan electrodes into two groups in the drive circuit shown in FIG. 2.

In the method shown in FIG. 3, the scan electrodes are divided into two groups each constituted by every other scan electrodes. Although not shown, it is possible to divide the scan electrodes into two groups each constituted by a plurality of scan electrodes. It is further possible to randomly divide the scan electrodes.

Furthermore, according to the present invention it is possible to obtain the same effect by applying the applied voltage potential difference compensation pulse voltage to either the scan or the sustaining electrode side. That is, it is also possible to divide the sustaining electrodes instead of the scan electrodes into two groups and apply the compensation pulses to the sustaining electrodes. This method will now be described as a second embodiment of the present invention.

Figure 4:
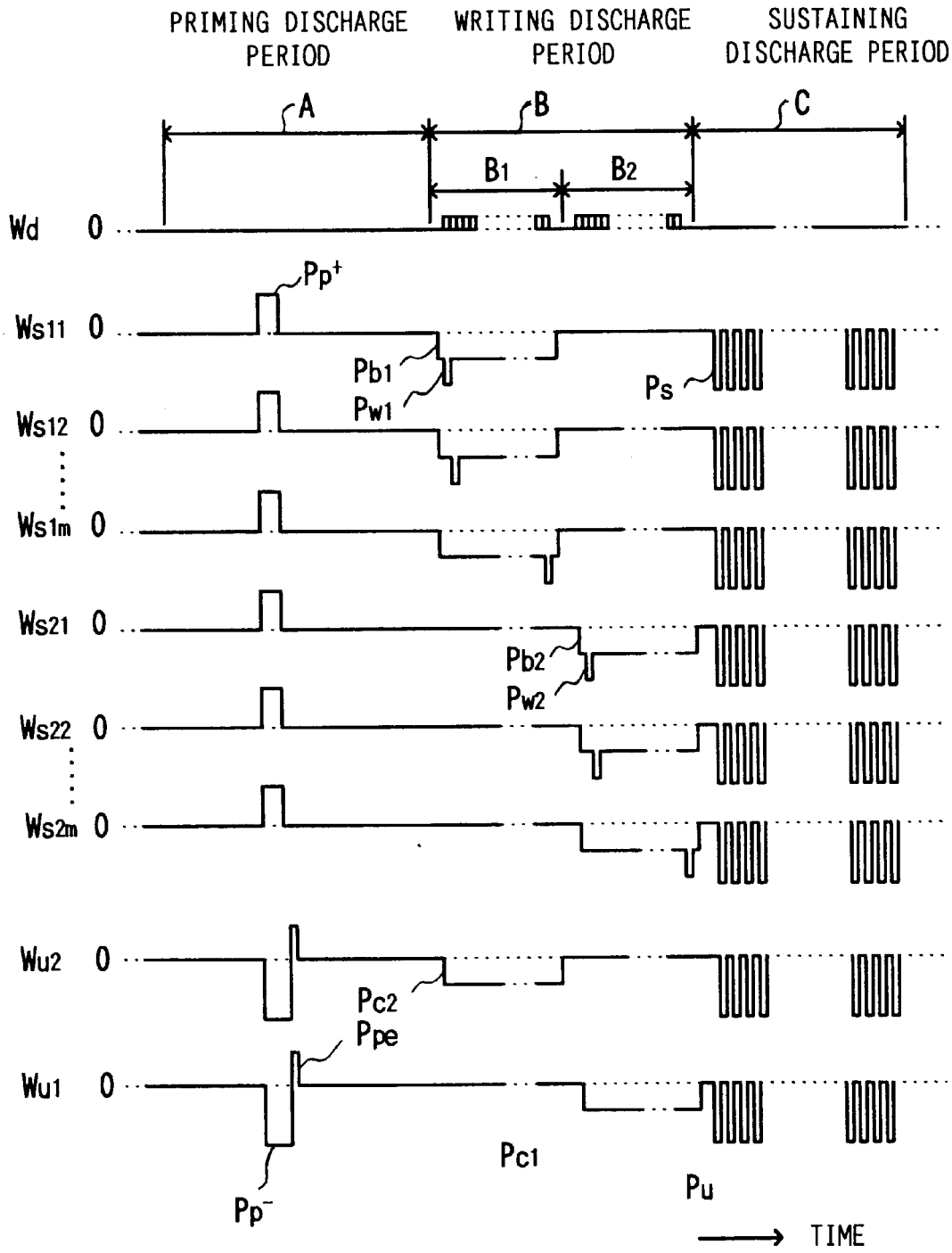
FIG. 4 is a waveform chart showing drive pulses for describing a second embodiment of the PDP driving method according to the present invention.
Figure 5:
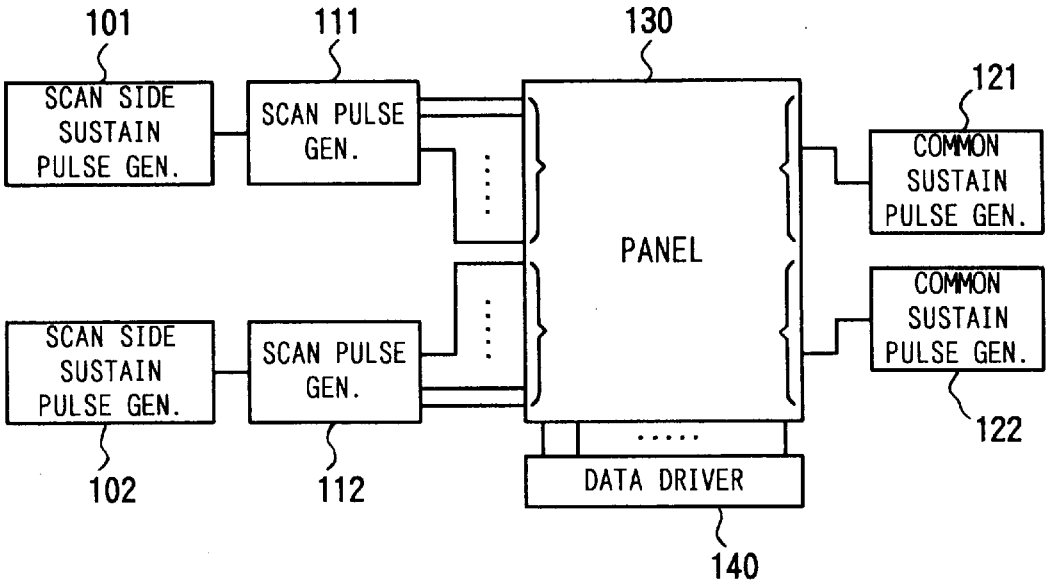
FIG. 5 is a block diagram showing a drive circuit for realizing the PDP driving method shown in FIG. 4.

FIG. 4 is a waveform chart showing drive pulses for describing a second embodiment of the PDP driving method according to the present invention. FIG. 5 is a block diagram showing a drive circuit for realizing the PDP driving method shown in FIG. 4. In this embodiment, a PDP having the electrode array as shown in FIGS. 7 and 8 is used again.

In this embodiment, as shown in FIG. 5, the scan electrodes in the PDP 130 are divided into two, i.e., first and second, groups. Scan electrode side sustaining pulse generators 101 and 102 for generating sustaining pulses to be applied to the scan electrodes and scan pulse generators 111 and 112 for generating scan pulses to be applied to the scan electrodes, are connected to the first and second electrode groups, respectively. The sustaining electrodes are also divided into two, i.e., first and second, groups. Common sustaining pulse generators 121 ands 122 for generating sustaining pulses to be applied to the sustaining electrodes, are connected to the first and second sustaining electrode groups, respectively. A data driver 140 is further connected to the PDP 130.

Of the scan electrodes $S_{c1}$ to $S_{cj}$ (j being an even number), the scan electrodes $S_{c1}$ to $S_{cm}$ (m=j/2) constitute the first scan electrode group, and are designated by $S_{c11}, S_{c12}, \ldots, S_{c1m}$. Of the scan electrodes $S_{c1}$ to $S_{cj}$, the scan electrodes $S_{c(m+1)}$ to $S_{cj}$ constitute the secon scan electrode group, and are designated by $S_{c21}, S_{c22}, \ldots, S_{c2m}$.

Of the sustaining electrodes $S_{u1}$ to $S_{uj}$ (j being an even number), the sustaining electrodes $S_{u1}$ to $S_{um}$ (m=2/j) constitute the first sustaining electrode group designated by $S_{u11}$. Of the sustaining electrodes $S_{u1}$ to $S_{uj}$, the sustaining electrode $S_{u(m+1)}$ to $S_{uj}$ cnstitute the second sustaining electrode group designated by $S_{u21}$.

Referring to FIG. 4, designated by $W_{u1}$ and $W_{u2}$ are sustaining electrode drive voltage waveforms applied commonly to the first and second sustaining electrode groups $S_{u11}$ and $S_{u21}$, respectively, $W_{s11}, W_{s12}, \ldots, W_{s1m}$ scan electrode drive voltage waveforms applied to the scan electrodes $S_{c11}, S_{c12}, \ldots, S_{c1m}$, respectively, in the first scan electrode group, $W_{s21}, W_{s22}, \ldots, W_{s2m}$ scan electrode drive voltage waveforms applied to the scan electrodes $S_{c21}, S_{c22}, \ldots, S_{c2m}$, respectively, in the second scan electrode group, and $W_d$ a data electrode drive voltage waveform applied to the data electrode $D_1, D_2, \ldots, D_k$.

One PDP drive cycle is constituted by a priming discharge period A, a writing discharge period B and a sustaining period C. Desired image is obtained by repeating this drive cycle.

Figure 9:
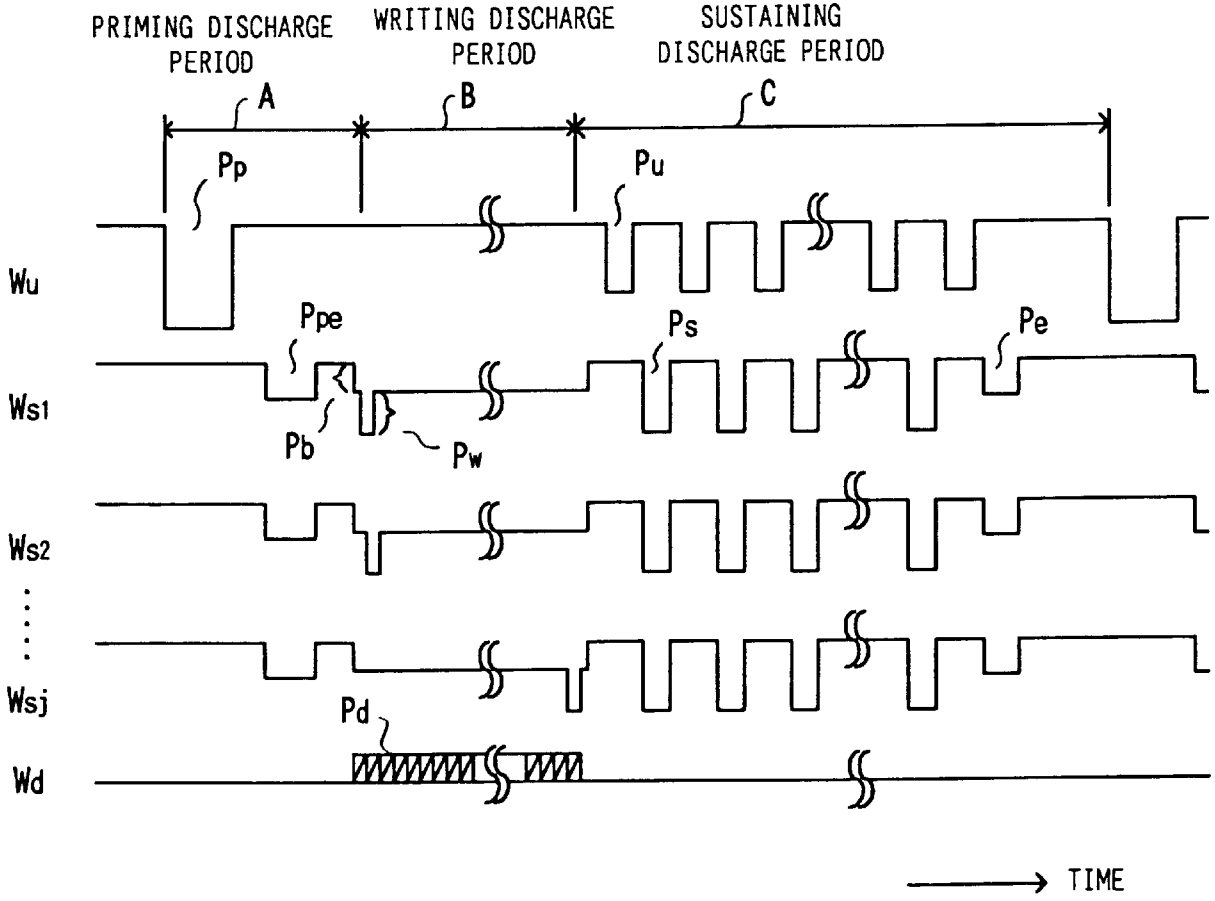
FIG. 9 PRIOR ART
FIG. 9 is a waveform chart showing a prior art example of drive pulses for driving the PDP shown in FIG. 8.
Figure 10:
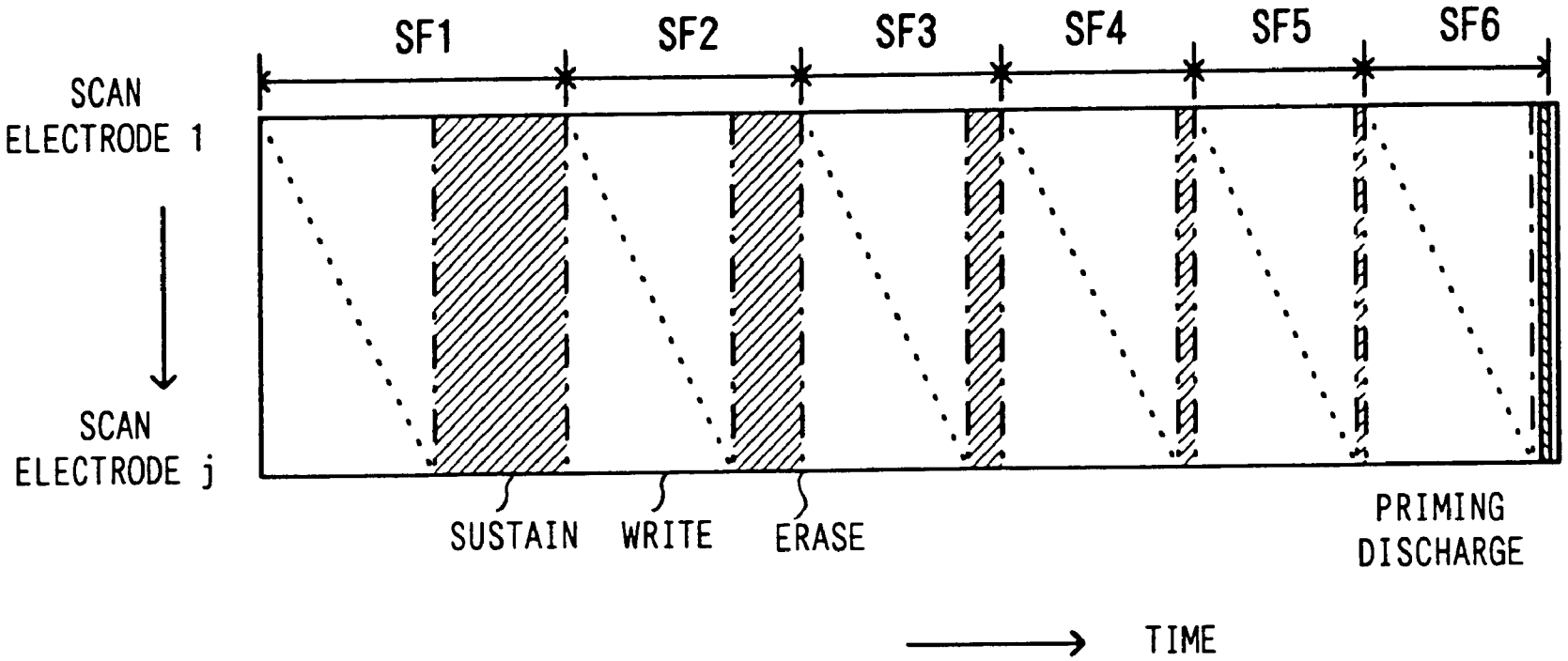
FIG. 10 PRIOR ART
FIG. 10 is a view for describing the sub-field method. In the Figure, the ordinate is taken for the scan electrode column, and the abscissa is taken for time.
Figure 11:
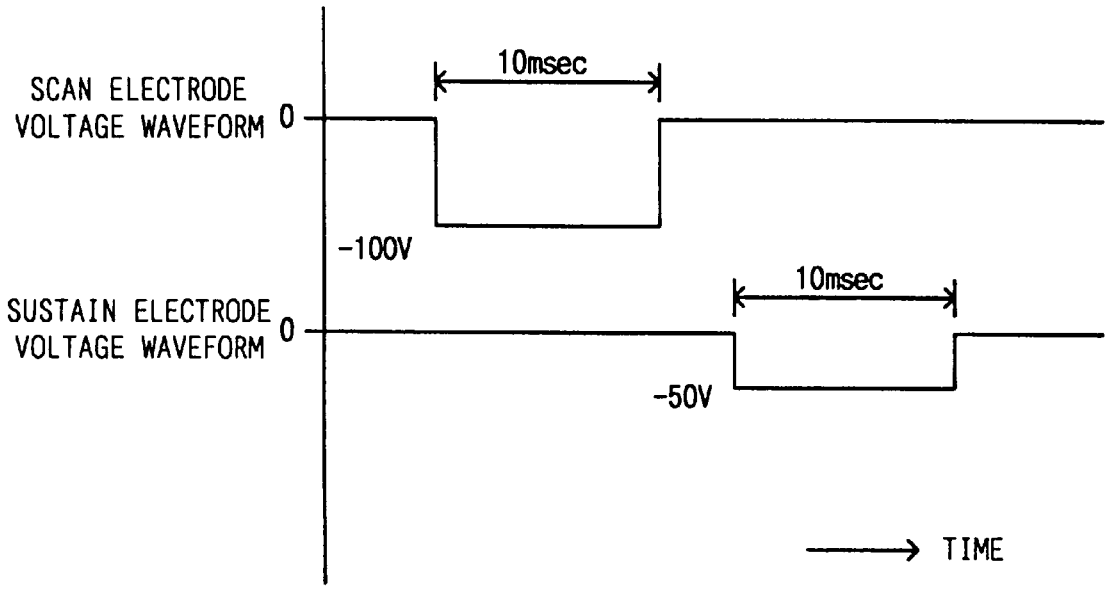
FIG. 11 PRIOR ART
FIG. 11 is a view showing an example of voltage waveforms, which brings about the electromigration.
Figure 12:
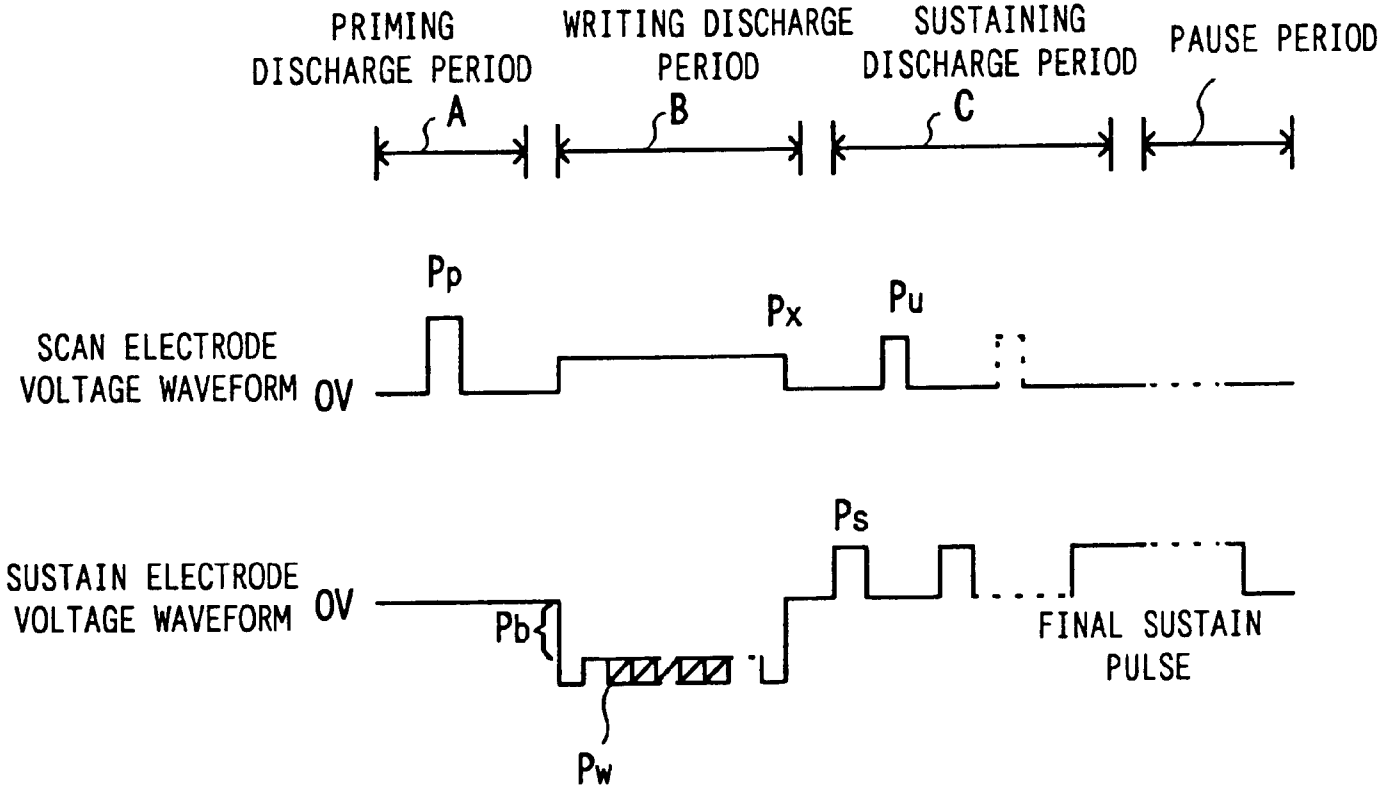
FIG. 12 PRIOR ART
FIG. 12 is a view showing an example of drive waveforms for preventing the electromigration.

In the priming discharge period A, priming discharge is brought about by applying a negative priming discharge pulse $P_p^-$ to all the sustaining electrodes and a positive priming discharge pulse $P_p^+$ to all the scan electrodes, and then is once de-sustained by applying a positive priming discharge erase pulse $P_{pe}$ to all the sustaining electrodes. Of course, as shown in FIG. 9, it is possible to apply the priming discharge pulse $P_{pe}$ to all the sustaining electrodes alone and then apply the priming discharge erase pulse $P_{pe}$ to all the scan electrodes.

In the sustaining discharge period C, as in the prior art, opposite polarity pulses are alternately applied to the scan and sustaining electrodes.

The operation in the writing discharge period B will now be described.

The writing discharge period B is again divided into a first and a second writing discharge period $B_1$ and $B_2$ set as scan periods for the first and second scan and sustaining electrode groups, respectively. In the first writing discharge period $B_1$, a scan base pulse $P_{b1}$ is applied to the scan electrodes in the first group, and scan pulses $P_{w1}$ are applied in superimposition on the scan base pulse $P_{b1}$. In this writing discharge period, a compensation pulse $P_{c2}$ is applied to the second group sustaining electrodes to make up for DC bias generated in the drive sequence. That is, the first writing discharge period $B_1$ is a non-scan period for the second group scan and sustaining electrodes.

The second writing discharge period $B_2$ which is the scan period for the second group scan and sustaining electrodes, is provided such that it does not overlap the first writing discharge period $B_1$ as the scan period for the first group scan and sustaining electrodes. Thus, after completion of the scanning of the first group scan electrodes, a scan base pulse $P_{b2}$ and scan pulses $P_{w2}$ are applied to the second group scan electrodes. In this period, a compensation pulse $P_{c1}$ is applied to the first group sustaining electrodes. The second scan period $B_2$ is thus a non-scan period for the first group scan electrodes.

The compensation pulses $P_{c1}$ and $P_{c2}$ are of the opposite polarity to the scan base pulses $P_{b1}$ and $P_{b2}$, but are the same in the voltage level and time length as the compensation pulses $P_{c1}$ and $P_{c2}$. Thus, they can perfectly cancel the DC bias due to the scan base pulses $P_{b1}$ and $P_{b2}$.

In the prior art, a compensation pulse which is different in the voltage level and time length from the scan base pulse is used to cancel the DC bias. However, since the electromigration effect varies non-linearly with respect to voltage, it has been difficult to cancel the effect of the DC bias with a different voltage.

According to the present invention, compensation pulse which is the same in the voltage level and time length as the scan base pulse generating the DC bias, is used, so that it is possible to readily obtain a perfect compensation effect. Besides, no particular pause period is necessary for applying the compensation pulse. That is, the insertion of the compensation pulse does not result in reduction of the sustaining period and reduction of the light intensity of emission.

The method of driving the scan electrodes and the sustaining electrodes paired therewith into two groups as described above, is by no means limitative.

Figure 6:
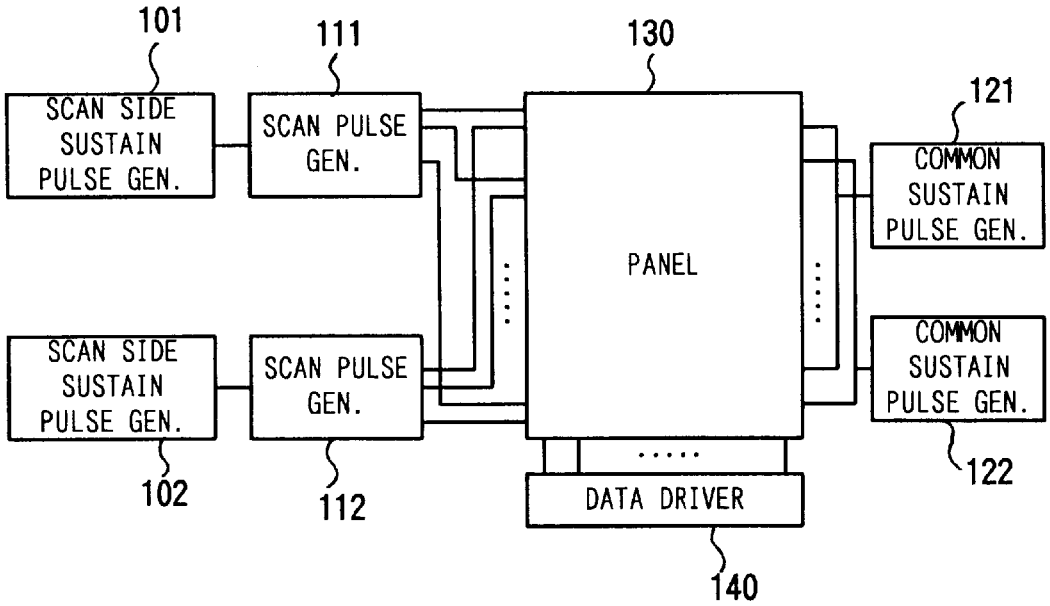
FIG. 6 is a block diagram showing a modification of the method of dividing the scan electrodes into two groups in the drive circuit shown in FIG. 5.

FIG. 6 is a block diagram showing a modification of the method of dividing the scan electrodes into two groups in the drive circuit shown in FIG. 5.

In the method shown in FIG. 6, the scan electrodes are divided into two groups each constituted by every other scan electrodes. Although not shown, it is possible to divide the scan electrodes into two groups each constituted by a plurality of scan electrodes. It is further possible to make random division.

In the above embodiments, only a single data driver was provided. However, since according to the present invention the unbalance due to the scan base pulses is made up for by the inter-planar discharge potential, the same effects are obtainable by providing the data driver side data electrodes such that every other ones of them or their upper and lower halves are provided in each of an upper and a lower group.

As has been described in the foregoing, according to the present invention the scan electrodes (or scan electrodes and sustaining electrodes paired therewith) are divided into a plurality of groups, and a compensation pulse voltage is applied, without application of scan base pulse, to the electrodes which are in their non-scan period during the writing discharge period. It is thus possible to perfectly erase a DC bias generated by the scan base voltage and extremely reduce resultant electromigration generated between the scan and sustaining electrodes.

It is thus possible to eliminate conductive tree-branch-like projections which were heretofore generated between the scan and sustaining electrodes, thus eliminating failure of normal operation due to quick reduction of the initial discharge voltage between the scan and sustaining electrodes while the PDP is in use. The operating life of the PDP thus can be extremely prolonged.

According to the present invention, it is also possible to reduce the period of application of the scan base pulse, which has been a cause of the voltage deviation.

Furthermore, without need of providing any pause period for the compensation pulse voltage application for making up for the electromigration, the sustaining period is not sacrificed. It is thus possible to suppress electromigration between the scan and sustaining electrodes while securing light intensity of emission which is comparable to that in the prior art by using the same techniques as therein, which is very useful in industries.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. In a plasma display comprising a plurality of scan electrodes provided on an insulating substrate, sustaining electrodes provided on the same insulating substrate so as to be paired with the scan electrodes, respectively, and parallel with the same, and a plurality of data electrodes provided on an insulating substrate facing the scan and sustaining electrodes so as to cross the same, data voltage corresponding to display data being supplied to the data electrodes, a method of driving the plasma display panel, in which display data is written in display cells by applying scan pulses to the scan electrodes during a scan period, during which a scan base pulse of a constant voltage is applied to the scan electrodes, comprising:

dividing the plurality of scan electrodes into a plurality of scan electrode groups having different scan periods; and applying a compensation pulse voltage to the scan electrodes in the scan electrode groups, which are in the non-scan periods during a writing discharge period of writing the display data in the display cells, to make up for a potential deviation generated between the scan and sustaining electrodes during the scan period.

2. The plasma display panel driving method according to claim 1, wherein:

the plurality of scan electrodes are divided into two scan electrode groups at the center of the electrode array in the scan direction thereof.

3. The plasma display panel driving method according to claim 1, wherein:

the plurality of scan electrodes are divided into two scan electrode groups each constituted by every other scan electrodes in the scan direction.

4. In a plasma display comprising a plurality of scan electrodes provided on an insulating substrate, sustaining electrodes provided on the same insulating substrate so as to be paired with the scan electrodes, respectively, and parallel with the same, and a plurality of data electrodes provided on an insulating substrate facing the scan and sustaining electrodes so as to cross the same, data voltage corresponding to display data being supplied to the data electrodes, a method of driving the plasma display panel, in which display data is written in display cells by applying scan pulses to the scan electrodes during a scan period, during which a scan base pulse of a constant voltage is applied to the scan electrodes, comprising:

dividing the pluralities of scan and sustaining electrodes into a plurality of scan and sustaining electrode groups having different scan periods; and applying a compensation pulse voltage to the scan and sustaining electrodes in the scan and sustaining electrode groups, which are in the non-scan periods during a writing discharge period of writing the display data in the display cells, to make up for a potential deviation generated between the scan and sustaining electrodes during the scan period.

5. A plasma display comprising a plurality of scan electrodes provided on an insulating substrate, sustaining electrodes provided on the same insulating substrate so as to be paired with the scan electrodes, respectively, and parallel with the same, and a plurality of data electrodes provided on an insulating substrate facing the scan and sustaining electrodes so as to cross the same, data voltage corresponding to display data being supplied to the data electrodes, display data being written in display cells by applying scan pulses to the scan electrodes during a scan period, during which a scan base pulse of a constant voltage is applied to the scan electrodes, wherein the plurality of scan electrodes are divided into a plurality of scan electrode groups having different scan periods; and a compensation pulse voltage generator for applying a compensation pulse voltage to the scan electrodes in the scan electrode groups, which are in the non-scan periods during a writing discharge period of writing the display data in the display cells, to make up for a potential deviation generated between the scan and sustaining electrodes during the scan period.

6. A plasma display comprising a plurality of scan electrodes provided on an insulating substrate, sustaining electrodes provided on the same insulating substrate so as to be paired with the scan electrodes, respectively, and parallel with the same, and a plurality of data electrodes provided on an insulating substrate facing the scan and sustaining electrodes so as to cross the same, data voltage corresponding to display data being supplied to the data electrodes, display data being written in display cells by applying scan pulses to the scan electrodes during a scan period, during which a scan base pulse of a constant voltage is applied to the scan electrodes, wherein the pluralities of scan and sustaining electrodes are divided into a plurality of scan and sustaining electrode groups having different scan periods; and a compensation pulse voltage generator for applying a compensation pulse voltage to the scan and sustaining electrodes in the scan and sustaining electrode groups, which are in the non-scan periods during a writing discharge period of writing the display data in the display cells, to make up for a potential deviation generated between the scan and sustaining electrodes during the scan period.

* * * * *